US005303282A

United States Patent [19]

Kwasnick et al.

[11] Patent Number: 5,303,282

[45] Date of Patent: Apr. 12, 1994

[54] RADIATION IMAGER COLLIMATOR

[75] Inventors: Robert F. Kwasnick; Ching-Yeu Wei, both of Schenectady, N.Y.

[73] Assignee: General Electric Company, Schenectady, N.Y.

[21] Appl. No.: 31,450

[22] Filed: Mar. 15, 1993

Related U.S. Application Data

[62] Division of Ser. No. 802,797, Dec. 6, 1991, Pat. No. 5,231,654.

[51] Int. Cl.[5] ..... G21K 1/02

[52] U.S. Cl. ..... 378/147; 378/154; 430/4

[58] Field of Search ..... 378/147, 35, 149, 154; 430/4, 5, 6, 269, 270, 297, 298

[56] References Cited

U.S. PATENT DOCUMENTS

| | | | |
|---|---|---|---|
| 2,806,958 | 9/1957 | Zunick | 378/154 |
| 4,288,697 | 9/1981 | Albert | 250/505 |
| 4,321,473 | 3/1982 | Albert | 250/505 |
| 4,393,127 | 7/1983 | Greschner et al. | 378/161 |
| 4,638,499 | 1/1987 | Eberhard et al. | 378/154 |
| 4,958,081 | 9/1990 | Malmin et al. | 250/505.1 |
| 4,969,176 | 11/1990 | Marinus | 378/149 |

*Primary Examiner*—David P. Porta

*Attorney, Agent, or Firm*—Donald S. Ingraham; Marvin Snyder

[57] ABSTRACT

A collimator for use in an imaging system with a radiation point source has a plurality of channels formed therein along longitudinal axes aligned with selected orientation angles that correspond to the direct beam path from the radiation source to the radiation detectors. The collimator comprises a photosensitive material coated with a radiation absorbent material. The cross-sectional shape of the channels corresponds to the cross-sectional shape of the radiation detecting area of the detector element adjoining the channel, and the sidewalls of the channel are smooth along their length. The collimator may be fabricated by forming a mask on a photosensitive collimator substrate, exposing the photosensitive substrate to light beams traveling along a path corresponding to a direct path of radiation from the radiation source to the detector elements in the assembled array, etching the collimator substrate to form channels therein along the exposed area of the substrate, and coating the substrate with a radiation absorbent material.

16 Claims, 3 Drawing Sheets

RADIATION IMAGER COLLIMATOR

This application is a division of application Ser. No. 07/802,797, filed Dec. 6, 1991 now U.S. Pat. No. 5,231,654.

CROSS REFERENCE TO RELATED APPLICATIONS

This application is related to the application of C. Y. Wei, R. F. Kwasnick, and G. E. Possin entitled "X-ray Collimator," Ser. No. 802,789, now U.S. Pat. No. 5,231,655 filed concurrently with this application, and assigned to the assignee of the present application.

FIELD OF THE INVENTION

This invention relates generally to radiation imagers, and in particular to focused collimators used in conjunction with radiation detection equipment.

BACKGROUND OF THE INVENTION

Collimators are used in a wide variety of equipment in which it is desired to permit only beams of radiation emanating along a particular path to pass beyond a selected point or plane. Collimators are frequently used in radiation imagers to ensure that only radiation beams emanating along a direct path from the known radiation source strike the detector, thereby minimizing detection of beams of scattered or secondary radiation. Collimator design affects the field-of-view, spatial resolution, and sensitivity of the imaging system.

Particularly in radiation imagers used for medical diagnostic analyses or for non-destructive evaluation procedures, it is important that only radiation emitted from a known source and passing along a direct path from that source through the subject under examination be detected and processed by the imaging equipment. If the detector is struck by undesired radiation, i.e., radiation passing along non-direct paths to the detector, such as rays that have been scattered or generated in secondary reactions in the object under examination, performance of the imaging system is degraded. Performance is degraded by lessened spatial resolution and lessened energy resolution that result from noise in the signal processing circuits generated by the detection of the scattered or secondary radiation rays.

Collimators are positioned to substantially absorb the undesired radiation before it reaches the detector. The collimator comprises a relatively high atomic number material placed so that radiation approaching the detector along a path other than one directly from the known radiation source strikes the body of the collimator and is absorbed before being able to strike the detector. In a typical detector system, the collimator includes barriers extending outwardly from the detector surface in the direction of the radiation source so as to form channels through which the radiation must pass in order to strike the detector surface.

Some radiation imaging systems, such as computerized tomography (CT) systems used in medical diagnostic work, use a point (i.e. a relatively small, such as 1 mm in diameter or smaller) source of x-ray radiation to expose the subject under examination. The radiation passes through the subject and strikes a radiation detector positioned on the side of the subject opposite the radiation source. In a CT system the radiation detector typically comprises a number of one-dimensional arrays of detector elements. Each array is disposed on a flat panel or module, and the flat panels are typically arranged end to end along a curved surface to form a radiation detector arm. The distance to a given position on any of the separate panels, typically the center of the panel, on any one of the separate panels is the same, i.e., each panel is at substantially the same radius from the radiation source. On any given panel there is a difference from one end of the panel to the other in the angle of incidence of the radiation beams arriving from the point source. In any system using a "point source" of radiation and flat panels or modules of detector elements, some of the radiation beams that are desired to be detected, i.e., ones emanating directly from the radiation source to the detector surface, strike the detector surface at some angle offset from vertical.

For example, in a common medical CT device, the detector is made up of a number of panels, each of which has dimensions of about 32 mm by 16 mm, positioned along a curved surface having a radius of about 1 meter from the radiation point source. Each panel has about 16 separate detector elements about 32 mm long by 1 mm wide arranged in a one-dimensional array, with collimator plates situated between the elements and extending outwardly from the panel to a height above the surface of the panel of about 8 mm. As the conventional CT device uses only a one-dimensional array (i.e., the detector elements are aligned along only one row or axis), the collimator plates need only be placed along one axis, between each adjoining detector element. Even in an arrangement with a panel of sixteen 1 mm-wide detector elements adjoining one another (making the panel about 16 mm across), if the collimator plates extend perpendicularly to the detector surface, there can be significant "shadowing" of the detector element by the collimator plates towards the ends of the panel. This shadowing results from some of the beams of incident radiation arriving along a path such that they strike the collimator before reaching the detector surface. Even in small arrays as mentioned above (i.e. detector panels about 16 mm across), when the source is about 1 meter from the panel with the panel positioned with respect to the point source so that a ray from the source strikes the middle of the panel at right angles, over 7.5% of the area of the end detector elements is shadowed by collimator plates that extend 8 mm vertically from the detector surface. Even shadowing of this extent can cause significant degradation in imager performance as it results in nonuniformity in the x-ray intensity and spectral distribution across the detector module. In the one-dimensional array, the collimator plates can be adjusted slightly from the vertical to compensate for this variance in the angle of incidence of the radiation from the point source.

Advanced CT technology, however, requires use of two-dimensional arrays, i.e., arrays of detector elements on each panel that are arranged in rows and columns. In such an array, a collimator must separate each detector element along both axes of the array. The radiation vectors from the point source to each detector on the array have different orientations, varying both in magnitude of the angle and direction of offset from the center of the array. Setting up collimator plates along two axes between each of the detector elements in two dimensional arrays would be extremely time consuming and difficult. Additionally, arrays larger than the one dimensional array discussed above may be advantageously used in imaging applications. As the length of any one panel supporting detector elements increases, the problem of the collimator structure shadowing large areas of the detector surface becomes more important.

Accordingly, one object of the present invention is to provide a highly focused collimator for use in imagers having point radiation sources and an efficient method to readily fabricate such a collimator.

Another object is to provide a readily-fabricated collimator for use with two-dimensional detector arrays in conjunction with a point radiation source.

SUMMARY OF THE INVENTION

In a radiation detecting system in which the radiation desired to be detected is emitted from a single point source, a collimator is provided which has channels that allow radiation emanating along a direct path from the point source to pass through to underlying radiation detectors while substantially all other radiation beams striking the collimator are absorbed. The axis of each channel has a selected orientation angle so that it is substantially aligned with the direct beam path between the radiation point source and the underlying radiation detector element. The sidewalls of the collimator are substantially smoothly shaped with a uniform slope and the channels preferably have a cross-sectional shape that corresponds to the shape of the adjoining detector element. The collimator body comprises at least one substrate made of a photosensitive material, the surfaces of which are coated with a radiation absorbent material. The radiation absorbent material is selected to absorb radiation of the energy level and wavelength emitted by the radiation source and typically comprises a material having a relatively large atomic number (i.e., about 72 or larger). The collimator body may be formed from two or more collimator substrates joined together so that the passages in each substrate are aligned to form channels through the assembled device that have the desired selected orientation angle. Such a collimator is advantageously used in an x-ray imager having a two-dimensional radiation detector array.

A method of forming a collimator is also provided, including the steps of forming a mask corresponding to the pattern of radiation detector elements; exposing the photosensitive substrate through the mask to light beams passing along paths corresponding to those taken by light emitted from a point source, the light beams exposing the photosensitive substrate at respective selected orientation angles; etching the photosensitive material to form channels having the selected orientation angle; and coating the photosensitive collimator substrate with a radiation absorbent material.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE PREFERRED EMBODIMENT

Figure 1:
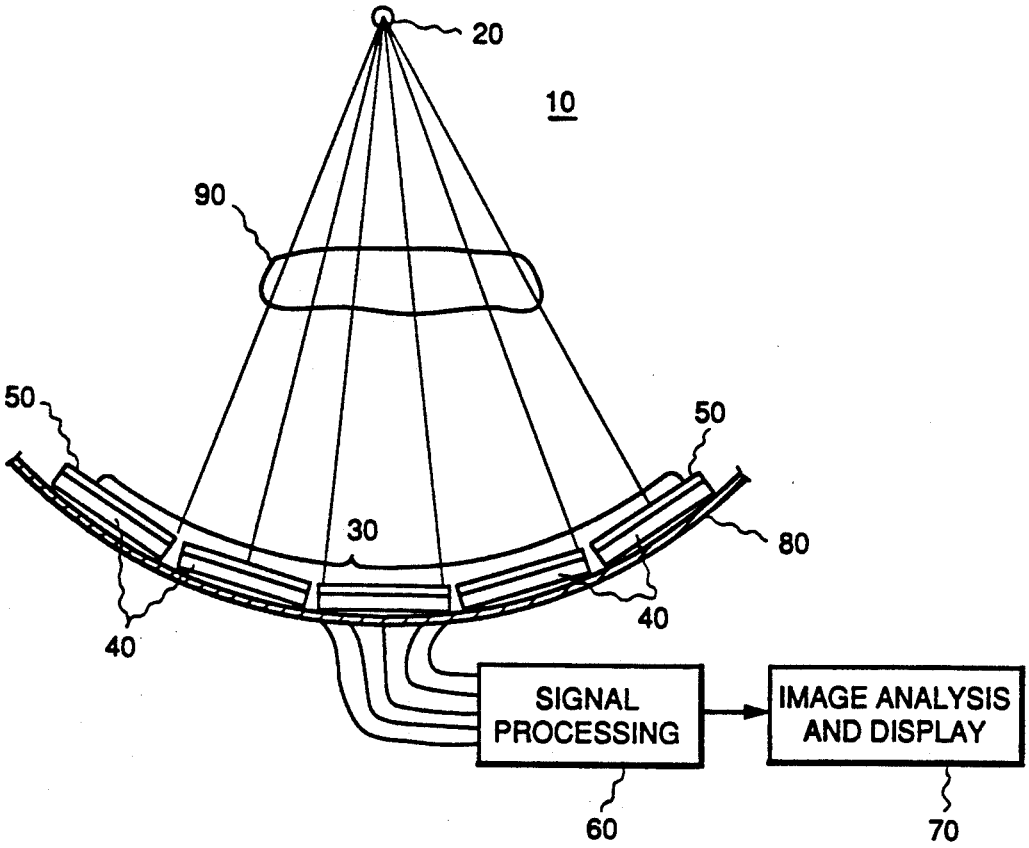
FIG. 1 is a schematic diagram of a CT radiation imaging device incorporating the collimator of the present invention.

A radiation imager system 10, such as a medical computed tomography (CT) system, incorporating the device of the present invention is shown in schematic form in FIG. 1. CT system 10 comprises a radiation point source 20 and a radiation detector 30 comprising a plurality of radiation detector panels 40 and a plurality of collimators 50 disposed between radiation source 20, typically an x-ray source, and detector panels 40. Each detector plate comprises a plurality of detector elements (not shown) that convert incident radiation into electrical signals. The detector elements are typically arranged in a one- or two-dimensional array. The radiation detector elements are coupled to a signal processing circuit 60 and thence to an image analysis and display circuit 70. Detector panels 40 are mounted on a curved supporting surface 80 which is positioned at a substantially constant radius from radiation point source 20.

This arrangement allows an object or subject 90 to be placed at a position between the radiation source and and the radiation detector for examination. Collimators 50 are positioned over radiation detector panels 40 to allow passage of radiation beams that emanate directly from radiation source 20, through exam subject 90, to radiation detector panels 40, while absorbing substantially all other beams of radiation that strike the collimator. The details of steps in the fabrication, and the resulting structure, of collimators 50 in accordance with this invention are set out below.

Figure 2:
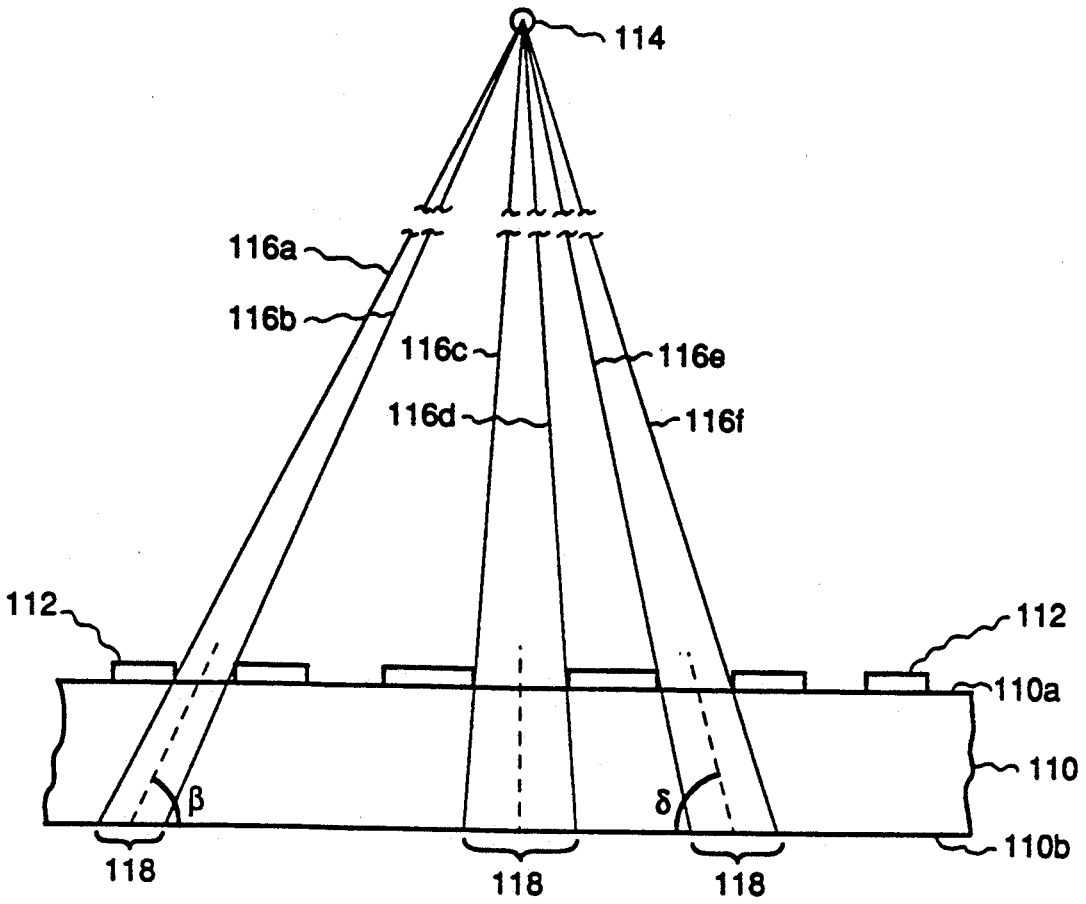
FIG. 2 is a cross-sectional view of the device of the present invention during one step of the fabrication process.

FIG. 2 is a cross-sectional view of a representative portion of a collimator substrate 110. Substrate 110 comprises photosensitive material, i.e., a material that will react to exposure to light in a manner similar to photoresist, to allow etching of a pattern in the material. Such photosensitive material may lose its photosensitive characteristics after it has been exposed to light and processed. One example of this type of substrate material is the Corning, Inc. product known as Fotoform® glass. An optically opaque mask 112 is formed by conventional methods on a first surface **110*a* of collimator substrate 110. The pattern of openings in mask 112 corresponds to the pattern of detector elements in each radiation detector panel 40 (FIG. 1). For example, mask 112 would have a pattern generally mimicking the arrangement, e.g., rows and columns in a two-dimensional array, as well as the cross-sectional shapes of detector elements at the interface between radiation detector panel 40 and collimator 50 (FIG. 1). Alternatively, mask 112 need not be on the surface of the collimator substrate but can be positioned with respect to the substrate in accordance with known photolithographic techniques to provide the desired exposure of the photosensitive material in substrate 110. In any event, the pattern of the mask is selected to expose areas of photosensitive collimator substrate 110 of sufficient size and orientation so that, upon completion of the fabrication of collimator 50**, the surface of each radiation detector element for receiving the radiation is exposed to radiation passing along the desired paths from the radiation source.

In accordance with the present invention, collimator substrate 110 and mask 112 are exposed to light from light source 114. Light source 114 is preferably a laser, an ultraviolet light source, or the like, and is positioned with respect to collimator substrate 110 so that light beams pass through the openings in mask 112 and strike collimator substrate 110 along paths corresponding to direct paths between radiation point source 20 and radiation detector 30 (FIG. 1). As illustrated in FIG. 2, exemplar pairs of light beams 116*a–b*, 116*c–d*, and 116*e–f* define the boundaries of exposed photosensitive material shown in cross section. The light beams exposing the photosensitive material under each respective opening in mask 112 strike the collimator substrate at slightly different angles, the magnitude and orientation of which depend on the position along the length of the collimator substrate where the light strikes. For example, light beams 116*a* and 116*b* strike the collimator substrate at angles which differ in magnitude and orientation (i.e. left or right with respect to a perpendicular between the substrate and the light source) from light beams 116*c–d* and 116*e–f*. The light beams falling on photosensitive collimator substrate 110 define a plurality of respective exposed volumes 118 in the photosensitive material under each opening in the mask through which the light beams pass. Each exposed volume 118 has a longitudinal axis at a selected orientation angle corresponding to the angle at which the light beams emanating along a direct path from light source 114 strike the collimator substrate. Thus light beams 116*a–b* expose a volume that has a selected orientation angle $\beta$, whereas light beams 116*e–f* expose a volume having a different selected orientation angle, $\partial$. The position of the collimator substrate with respect to light source 114 is selected to correspond with the distance that the collimator substrate will be from the radiation source in the assembled imager. Further, to ensure that the exposed volumes have the correct selected orientation angles required for collimating radiation in the assembled device, the plane of the collimator substrate is oriented at a "planar angle" so that the plane of the substrate has the same orientation with respect to the light source as the radiation detector panel with respect to the radiation source in the assembled device.

Figure 3:
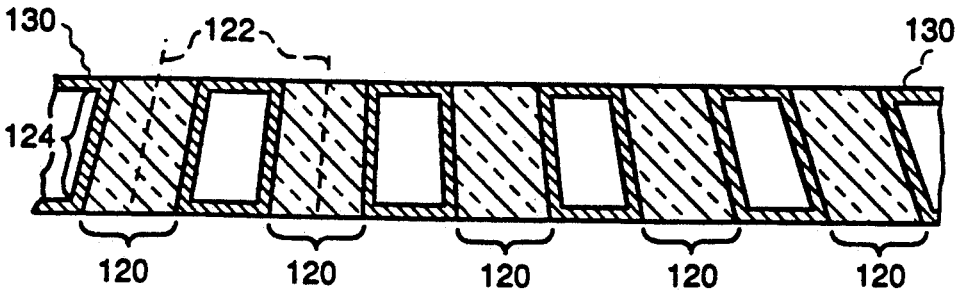
FIG. 3 is a cross-sectional view of a collimator fabricated in accordance with one embodiment of the present invention.

Collimator substrate 110 is then etched using conventional techniques appropriate for the photosensitive material used in the substrate to remove the exposed volumes 118 of photosensitive material and create a plurality of channels or passages 120 through the substrate, as illustrated in FIG. 3. Each of these channels has a longitudinal axis 122 aligned with the selected orientation angle defined when the photosensitive material was exposed to light source 114 (FIG. 2). Typically the selected orientation angles of the longitudinal axes of the channels range between about 0° and 10°. Each channel has a channel sidewall 124 which is substantially smooth along its length and has a substantially uniform slope formed when the photosensitive material exposed by the light beams in the previous step is removed in the longitudinal axes of the channels range between about 0° and 10°. Each process. The slope of the sidewalls is typically substantially aligned with the selected orientation angle of the channel defined by those sidewalls. The remaining portions of mask 112 may next removed to prepare the collimator substrate for the next step in the process of forming the collimator.

A radiation absorbent material layer 130 (FIG. 3) is then applied on collimator substrate 110 so as to cover at least the surfaces of the substrate which will be exposed to incident radiation when assembled in an imager device. The radiation absorbent material at least covers all of the sidewalls defining the channel. The cross-sectional portion of the radiation absorbent material on the sidewalls and the top and bottom of substrate 110 is illustrated in FIG. 3 in cross-hatch, while the radiation absorbent material on the "back" sidewall of the channel is illustrated in alternating cross-hatch and dashed lines. The radiation absorbent material can be applied through known techniques, such as vapor deposition techniques. Radiation absorbent material 130 is selected to absorb radiation of the wavelength distribution emitted by radiation source 20 (FIG. 1) in the imager device. The radiation absorbent material typically has a relatively high atomic number, e.g., greater than about 72, and advantageously comprises tungsten, lead, or gold when the radiation used in the imager device is x-ray. The thickness of the radiation absorbent material layer is selected to provide efficient absorption of the incident radiation and depends on the type of incident radiation and the energy level of the radiation when it strikes the collimator. For example, in a typical CT system using an x-ray point radiation source of about 100 KeV positioned approximately one meter from the detector array, a total thickness in the range of about 30 to 40 mils of tungsten in one or more layers disposed along the path of the radiation will substantially absorb the x-rays emitted by the source. After application of the radiation absorbent material, the cross-sectional area of the opening or void space in the channel is substantially the same as the area for receiving radiation on the detector element which it adjoins so as to allow substantially all radiation rays emanating along direct paths from the radiation source to strike the detector element. When two or more substrates are joined together to form the collimator body, the openings of the channels in the respective surfaces of the collimator substrates are aligned to form continuous channels through the collimator body. The channel sidewalls are advantageously aligned so that the sidewalls of the respective channels in the adjoining substrates are contiguous. Dependent on the energy level and wavelength of the radiation to be collimated, different thicknesses of collimator bodies may be required. Once the necessary thickness has been determined, an appropriate thickness of collimator substrate, or plurality of substrates, can be selected and fabricated in accordance with this invention. For example, the thickness of a collimator for an imager system using x-rays, such as a CT system, may be only about 8 mm, but for an imager using gamma rays, the collimator preferably would be three to five times thicker than that used for x-ray radiation.

Figure 4:
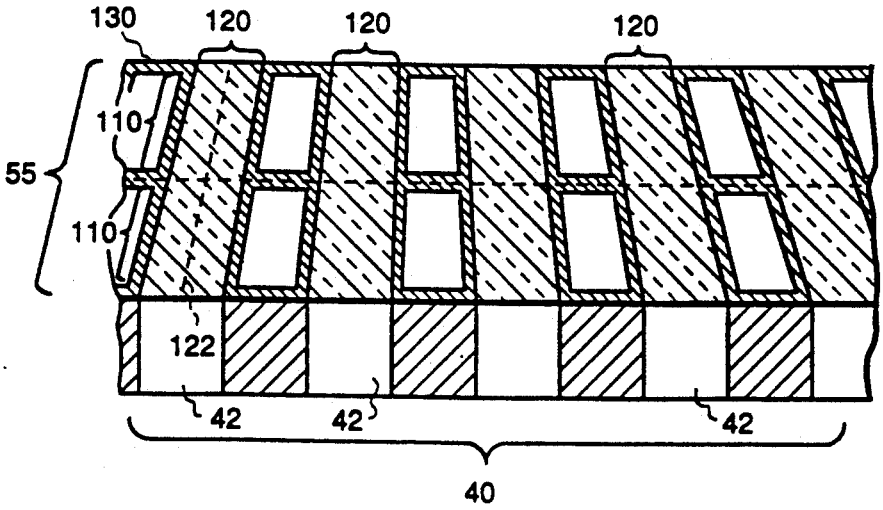
FIG. 4 is a cross-sectional view of a radiation imaging device having a collimator fabricated in accordance with one embodiment of the present invention.

In the assembled device, collimator body 55 is disposed to adjoin radiation detector panel 40, as illustrated in FIG. 4. Radiation detector elements 42 are positioned along detector panel 40 and typically comprise a scintillator coupled to a photodetector. Collimator body 55 is positioned to allow incident radiation on a direct path between the radiation source and one of the radiation detector elements 42 to pass through the channels in the collimator. Beams of radiation that are not aligned with such a direct path strike the collimator body and are absorbed.

Figure 5:
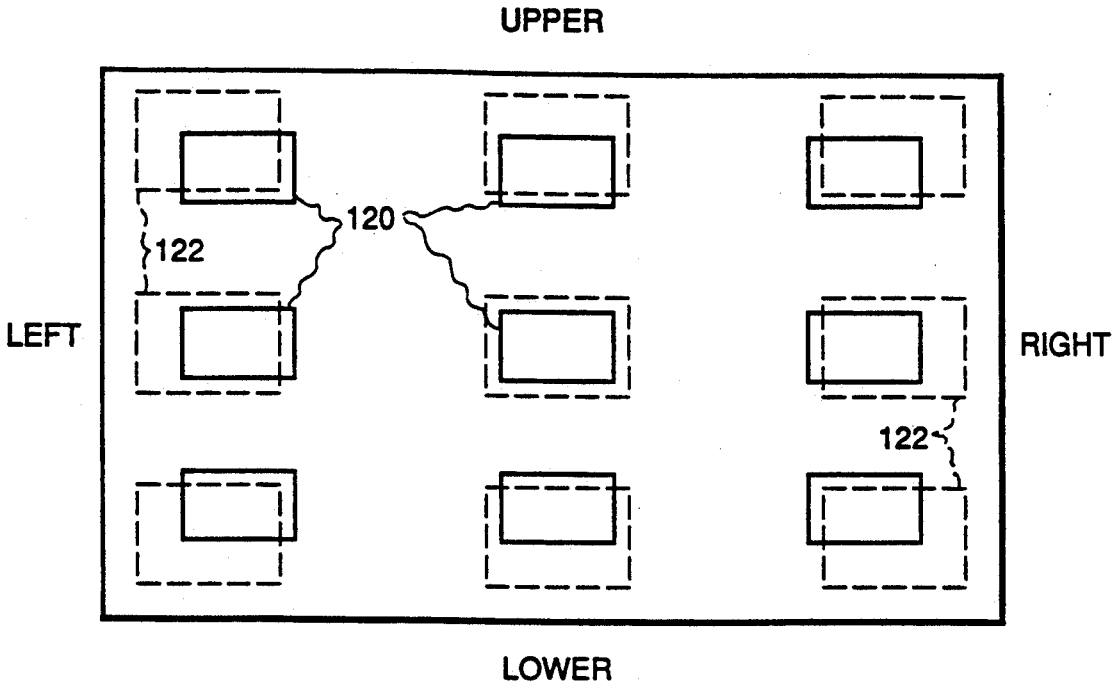
FIG. 5 is a plan view of a collimator fabricated in accordance with the present invention for use with a two-dimensional detector array.

The collimator of the present invention is readily used with either a one-dimensional or a two-dimensional array of radiation detector elements. A plan view of a collimator fabricated in accordance with the present invention and showing a representative number of channels 120 appears in FIG. 5. The figure has been marked to show left, right, upper and lower edges solely to provide a reference for ease of discussion, and the selection and positioning of such references is not meant to constitute any limitation on the structure or positioning of the device of the invention. Openings 122 of channels 120 on the opposite surface of collimator body 55 are shown in phantom. In the two-dimensional array the center channel is in substantial vertical alignment with the radiation source, and the opening 122 of the channel on the side of the collimator body opposite the radiation source is aligned with the opening in the surface closest to the radiation source. As the radiation beams spread out as they emanate from the point source, each of openings 122 has a slightly larger cross-sectional area than the respective opening of the channel 120 in the surface of the collimator closest to the radiation source. Openings 122 for channels on the left, right, top, or bottom are slightly offset from being in vertical alignment with their respective openings in the upper surface of the substrate. The direct path from the radiation source to a radiation detector in the upper left hand corner, for example, is offset both to the left and the upper side of the array. The selected orientation angle of the axis of the channel is substantially aligned with this direct path, and the channel thus extends through the collimator body at this angle. The selected orientation angle for each channel is different from any other channel in the collimator. Such a structure, which would be extremely difficult and time consuming to construct with conventional collimator fabrication techniques, is readily produced in accordance with this invention.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method of forming a collimator for use with a radiation point source adapted to emit radiation having a predetermined wavelength distribution, said collimator comprising:

forming a mask having a pattern of openings therein corresponding to a pattern of detector elements in a radiation detector array to which said collimator is to be mated;

exposing a photosensitive substrate to light beams passing through said mask and along paths corresponding to direct paths extending between said radiation point source and said collimator such that unmasked portions of said substrate are exposed at respective selected orientation angles;

etching said photosensitive substrate to form channels therein such that said channels have respective longitudinal axes aligned with respective ones of said selected orientation angles, said selected orientation angles being determined by the angle at which the light struck said photosensitive substrate; and applying a radiation absorbent material to said at least one photosensitive substrate, said radiation absorbent material being selected to absorb radiation of the wavelength distribution emitted by said radiation point source.

2. The method of claim 1 further comprising the steps of forming a plurality of substrates and joining said substrates together to align respective channels in said collimator substrates.

3. The method of claim 1 wherein the step of exposing said substrate further comprises the step of positioning said substrate with respect to a light point source so that light emitted from said light point source strikes said substrate at the same angle that radiation emitted from said radiation point source would strike said collimator in the assembled device.

4. The method of claim 3 wherein the step of positioning said substrate comprises situating said light point source at a selected distance from said substrate corresponding to the distance of said collimator from said radiation point source in said assembled device and orienting the plane of the surface of said substrate to be at a selected planar angle with respect to said light point source corresponding to the angle of said collimator with respect to said radiation point source in said assembled device.

5. The method of claim 3 wherein said light point source comprises an ultraviolet light source.

6. The method of claim 3 wherein said light point source comprises a laser.

7. The method of claim 1 wherein the step of etching said photosensitive substrate further comprises removing remaining portions of said mask from said substrate.

8. The method of claim 1 wherein said radiation absorbent material comprises tungsten.

9. A method of forming a collimator for use with a radiation point source adapted to emit radiation having a predetermined wavelength distribution, said collimator comprising:

forming a plurality of masks, each of said masks having a respective pattern of openings therein corresponding to a pattern of detector elements in a radiation detector array to which said collimator is to be mated;

exposing a plurality of photosensitive substrates to light beams emanating from a light point source, each of said photosensitive substrates being paired with a respective one of said masks through which said light beams pass along paths corresponding to direct paths extending between said radiation point source and said collimator such that unmasked portions of each respective one of said substrates are exposed at respective selected orientation angles;

etching each of said photosensitive substrates to form channels therein such that said channels have respective longitudinal axes aligned with respective ones of said selected orientation angles, said selected orientation angles being determined by the angle at which the light struck said photosensitive substrate;

applying a radiation absorbent material to each said etched substrates, said radiation absorbent material being selected to absorb radiation of the wavelength distribution emitted by said radiation point source; and joining said substrates together to form a collimator body having said respective channels in said collimator substrates aligned to form channels through said collimator body.

10. The method of claim 9 wherein the step of exposing each of said substrate further comprises the step of positioning each substrate with respect to said light point source so that light emitted from said light point source emanates along paths corresponding to the paths between said radiation point source and said radiation detector elements in the assembled device.

11. The method of claim 10 wherein the step of positioning each of said substrates comprises situating said light point source at a selected distance from each respective one of said substrates corresponding to the respective distances of said substrates in said collimator body from said radiation point source in said assembled device and orienting the plane of the surface of each of said substrates to be at a selected planar angle with respect to said light point source corresponding to the angle of said collimator body with respect to said radiation point source in said assembled device.

12. The method of claim 9 wherein said light point source comprises an ultraviolet light source.

13. The method of claim 9 wherein said light point source comprises a laser.

14. The method of claim 9 wherein the step of etching said photosensitive substrates further comprises removing remaining portions of said respective mask from respective ones of said substrates.

15. The method of claim 9 wherein said radiation absorbent material comprises tungsten.

16. The method of claim 9 wherein the step of joining said collimator plates together further comprises aligning said channels so that the sidewalls of respective ones of said channels that adjoin one another are substantially contiguous.

* * * * *